United States Patent [19]

Mirrione et al.

[11] 3,950,758

[45] Apr. 13, 1976

[54] SELF-LOCKING HINGE FOR ANTENNA ELEMENT

[75] Inventors: James J. Mirrione, Franklinton, N.C.; Jerome Berger, New York, N.Y.

[73] Assignee: JFD Electronics Corporation, Brooklyn, N.Y.

[22] Filed: Nov. 25, 1974

[21] Appl. No.: 526,710

[52] U.S. Cl. ..... 343/881; 403/92

[51] Int. Cl.[2] ..... H01Q 1/08

[58] Field of Search ..... 403/91, 92, 93, 95, 96; 343/880, 881, 882, 915

[56] References Cited

UNITED STATES PATENTS

| | | | |
|---|---|---|---|
| 609,634 | 8/1898 | Tanner | 403/102 |
| 1,226,324 | 5/1917 | Gage | 403/93 |
| 2,389,811 | 11/1945 | Ozlek | 403/92 |
| 2,580,117 | 12/1951 | McMackin et al. | 403/95 |
| 3,278,212 | 10/1966 | Kolb | 403/93 |
| 3,345,092 | 10/1967 | Athman et al. | 403/93 |

*Primary Examiner*—Eli Lieberman

*Attorney, Agent, or Firm*—Ostrolenk, Faber, Gerb & Soffen

[57] ABSTRACT

In an antenna for television, radio or the like, including antenna elements radiating from a boom, a self-locking hinge intermediate the ends of an antenna element for permitting folding of the element for convenient boxing, or the like and for permitting unfolding and elongation of the element for use; the hinge comprising a hinge connection that is spaced from one side of the element and a snap latch that is spaced from the opposite side of the element, thereby rigidifying and strengthening the hinge connection.

21 Claims, 6 Drawing Figures

SELF-LOCKING HINGE FOR ANTENNA ELEMENT

BACKGROUND OF THE INVENTION

Antennas for television reception, FM radio reception, or the like frequently consist of an elongated boom that is oriented horizontally when the antenna is in use, and secured in spaced relationship along the length of the boom are a plurality of pairs of dipole elements, each element of a dipole pair radiating from the opposite side of the antenna. For excellent color television reception, for television reception in fringe areas remote from the signal transmitter, and for adequate television reception over the full range of channels, the above type of television antennas have become quite large. The antenna booms are often quite long, e.g. in excess of 12 feet. In addition, some of the dipole elements are quite long, with the longest such elements often being a few feet in length. It is apparent that in use, such antennas are quite large and are quite cumbersome to handle and carry.

In order to be able to market antennas sucessfully, especially for "do-it-yourself" installations, they should be easily carried by a customer from the place of purchase to the place at which the antenna is to be installed. This requires that the antenna be made compact for sales, storage and travel purposes. For a relatively large antenna of the type discussed herein, a retailer should be able to display the antenna in a much smaller space on his sales floor, the box holding the antenna should be smaller than the assembled antenna and the customer should be able to easily carry the antenna from the retailer's stock.

State of the Prior Art

To make antennas more compact for transportation purposes, it is known to provide the elongated boom in a number of separated pieces which are conventionally fastened together, e.g. by a telescoping connection arrangement at the abutting ends of sections of the boom, at the time of installation. Furthermore, it is known to provide swivel type connections between the antenna elements and the boom or to market the antenna elements separated from the boom. At the time of installation, the antenna elements are respectively swiveled into position or attached in position to the boom and are ready for use. However, in the art, there is no presently acceptable way in which individual antenna elements are made shorter for sale and packaging purposes, while being adapted for easy extension into elongated antenna elements of the desired length.

Summary of the Invention

In accordance with the invention, each antenna element which it is desired to be able to temporarily shorten for purposes of sale, transportation, or the like, is divided into two sections intermediate its ends and a hinge joins the sections. A latch or lock is associated with the hinge. The hinge permits the antenna element to be folded to a considerably shorter length and to be unfolded to elongated straight extension and the latch or lock locks the antenna straight and prevents refolding thereof.

The hinge is adapted to permit the hinged together antenna element sections to be swiveled from a condition where the antenna element is shortened from its full length, e.g. the condition where the two element sections are parallel to each other, to a condition where the two element sections are coaxially aligned. The latch or lock includes a first lockable portion on one of the antenna element sections and a locking means, for engaging the lockable portion, on the other antenna element section. The lockable portion and the locking means are so positioned on their respective antenna element sections that the latter positively locks to the former upon the full extension of the antenna element. Later separation of the lock is quite difficult due to the positive nature of the locking.

In a preferred embodiment of the invention, the locking means comprises a resilient material extension from one side of and at the abutting end of the one antenna element section. There is a projection from the side of that extension. The lockable portion comprises a corresponding resilient material extension at one side of and at the abutting end of the other antenna element section and the latter extension is provided with an opening therethrough that is shaped and positioned to receive and capture the projection from the first mentioned extension. One or both of the extensions should be comprised of resilient material to enable snap latching of the two antenna element sections.

In accordance with a further aspect of the invention, both of the aforesaid extensions and the respective projection and projection capturing aperture therefor are a short distance away from the side of the antenna to enhance the ability of the locked connection to hold the antenna element sections in straight alignment because the lever arm between the hinge and the latch is increased in length. In a further development of this aspect, the cooperating elements formed on each antenna element section which cooperate to form the hinge are themselves on extensions away from the side of the antenna element and preferably project away from the antenna element in the opposite direction from the elements of the lock, thereby even further increasing the distance between the lock and the hinge and increasing the effective lever arm of the lock against refolding of the antenna element.

The entire self-locking hinge with its included extensions is arranged to enlarge the areas of engagement between the various portions of the hinge and of the lock to rigidify the connection between the antenna element sections and to ensure maintenance of electrical integrity along the full length of the antenna element. To this end, the cooperating extensions from the antenna element sections which carry the cooperating elements of the lock are relatively large surface area metal surfaces resiliently brought into facewise engagement, for providing a large surface area for electrical and mechanical interconnection. Furthermore, the elements of the hinge are carried on large surface area extensions and the surfaces of the extensions from each antenna element section are in facewise engagement for good electrical interconnection.

Accordingly, it is the primary object of the present invention to provide an effective means for enabling the length of an antenna element to be shortened prior to use of the antenna element and to easily enable the antenna element to be extended to its full length when it is to be used.

It is another object of the present invention to provide a means which accomplishes the foregoing object and assures good electrical conductivity along the length of the entire antenna element.

It is a further object of the invention to accomplish the foregoing objects and to further ensure that the mechanical strength of the antenna element will be maintained along its entire length.

It is yet another object of the invention to ensure that the antenna element can be securely locked in its extended condition.

These and other objects of the invention will become apparent from the following detailed description of the accompanying drawings.

DETAILED DESCRIPTION OF THE PREFERRED EMBODIMENT

Figure 1:
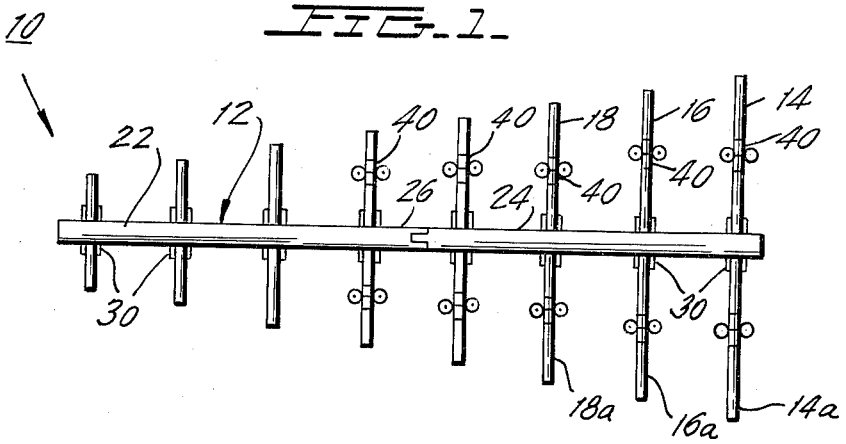
FIG. 1 shows a typical antenna boom carrying antenna elements, some of which are provided with the lockable hinge of the present invention.

Referring to FIG. 1, a plan view of a typical television antenna 10 is illustrated. The antenna includes a separable vertical support mast (not shown) for the boom, a boom 12 for carrying antenna elements, a plurality of antenna dipole element pairs 14, 14*a;* 16, 16*a;* 18, 18*a;* et al. The antenna elements are all conventional tubular metallic electrical conductors. Electric current lead wires (not shown) are conventionally connected to the antenna elements and conventionally deliver the received signal to a television, or the like receiver.

The present invention is particularly directed to an assembly for making the entire antenna 10 more compact.

It is known in the art to shorten the entire length of the boom 12 by separating it into separate boom sections 22, 24. Conventional telescoping connection 26 is intermediate the ends of the boom. When boom sections 22, 24 are telescoped together, they are then fastened at their telescoped connection 26 in a conventional manner.

One further known way to make the antenna 10 more compact is to attach the elements 14, 16 to the boom 12 at lockable mechanical swivel mounts 30 which enable the antenna elements to be swiveled from an inoperative position lying alongside the boom to the operative position illustrated in FIG. 1.

The present invention is concerned with a lockable hinge 40 which may be interposed between the ends of that antenna element which it is desired to make more compact prior to use of the antenna.

Figure 2:
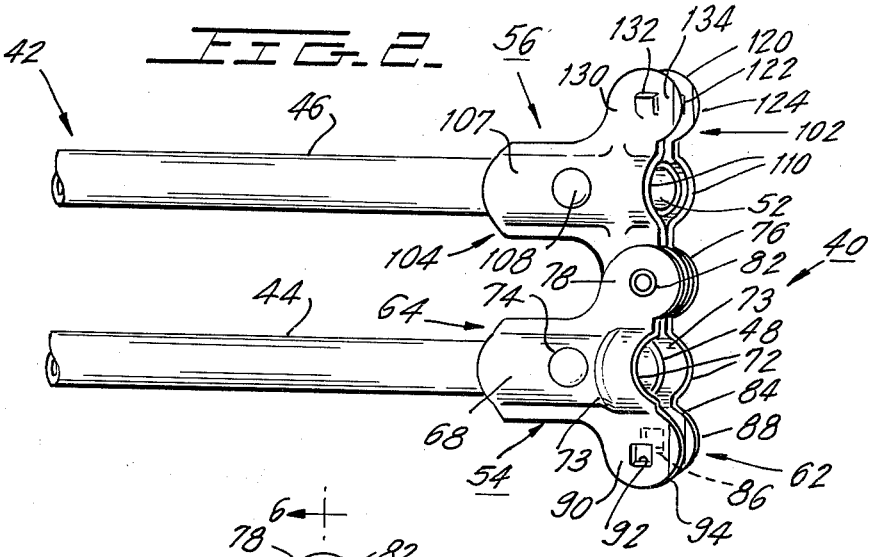
FIG. 2 is a perspective view of an antenna element carrying the lockable hinge of the present invention and the element being in its folded condition.

Turning to FIG. 2, a typical antenna element 42 is shown. It is comprised of two separate tubular sections 44, 46 of conductive metal, e.g. tubes of aluminum, which sections 44, 46 are joined together at hinge 40 and are hingedly pivotable between the folded condition illustrated in FIG. 2 and the unfolded, straight, antenna in use condition of FIG. 3. The end 48 of antenna element section 44 is brought by hinge 40 near to and is electrically joined with the end 52 of element section 46. Hinge 40 includes two separate sections, the lockable portion 54 and the locking means 56 which locks to portion 54.

The entire hinge 40 is comprised of electrically conductive metal and it is substantially rigid, except that certain portions thereof have sufficient resiliency to enable the locking together of the portions 54, 56, as described further.

Turning first to lockable portion 54, it is made up of two identical, but mirror imaged sections 62, 64. Section 62 includes the semi-cylindrical ferrule segment 66, which has an internal diameter equal to the external diameter of antenna element section 44 against which it seats securely. The section 64 has a corresponding semi-cylindrical ferrule segment 68. Ferrule segments 66, 68 are of such length and are so positioned on antenna element section 44 that the free ends 72 thereof extend by virtue of below described flared section 73 beyond the end 48 of antenna element section 44, but section 44 extends through and is thereby supported in virtually the entire length of ferrule segments 66, 68.

Mounting rivet 74 passes through the ferrule segments 66, 68 and through antenna element section 44, and the rivet joins the ferrule sections 66, 68 securely to the antenna element section 44. The curvatures of the ferrule segments and the curvature of antenna element section 44, coupled with rivet 74, precludes any shifting of lockable portion 54 with respect to antenna element section 44.

Projecting from the same side of ferrule segments 66, 68 and of antenna element section 44 are respective hinge plate extensions 76, 78. The inwardly facing surfaces of extensions 76, 78 respectively mate with below described plate extensions 111, 112, as described below. There is a respective clearance opening 80 through each extension 76, 78 and the hinge rivet 82 passes completely across extensions 76, 78 through openings 80 with sufficient clearance to permit these extensions to swivel around the rivet 82, as described below.

Note that the surface area of each of extensions 76 and 78 is considerably larger than the surface area required merely to contain opening 80 and is quite large relative to the cross-section of antenna element section 44. When extensions 76, 78 cooperate with below described extensions 111, 112 from antenna element section 46, each extension presents a large surface area for electrical contact, ensuring good electrical conductivity along the entire length of the antenna element 42. Also, there is secure mechanical interengagement over a large surface area, minimizing the possibility of twisting of antenna element section 44 with respect to antenna element section 46 (except, of course, for the desired pivoting around rivet 82).

Projecting from ferrule segment 66 in precisely the opposite direction from extension 76 is the plate-like extension 84, which carries lockable means 86. As illustrated, lockable means 86 comprises an aperture into which the below described projection 122 on plate extension 120 is snap fitted and resiliently locked. Extension 84 is substantially rigid, but it and/or its mounting to ferrule segment 66 has a slight resilience sufficient to enable it to move to accept below described projection 122.

Toward the projection entrance side (right side in FIG. 2) of extension 84 is formed the outwardly canted guidance tab 88 which guides below described projection 122 into aperture 86. As that projection moves over tab 88, it forces extension 84 outwardly enough to permit the projection to eventually snap into aperture 86. Then the resilience of extension 74 forces its inwardly directed snap return and secures projection 122 in opening 86.

Without detailing the structure, extension 90 corresponds to and is a mirror image of the extension 84 and its opening 92, its outwardly canted guidance tab 94 and its resilience all function in the same manner with respect to projection 132 on extension 130 as the corresponding features of extension 84.

Note that the surface area of each of extensions 84, 90 is considerably larger than the surface area required to contain apertures 86, 92. When extensions 84, 90 cooperate with below described extensions 120, 130, there is a large surface area for electrical contact for good conductivity and there is secure mechanical interengagement over a large surface area, minimizing the possibility of relative twisting of antenna element sections 44, 46.

Turning to locking means 56, it has many structural characteristics similar to those for lockable portion 54. Locking means 56 is comprised of two identical, but mirror imaged, sections 102, 104. Section 102 includes the semi-cylindrical ferrule segment 106, that is curvedly shaped to seat securely on the exterior of its antenna element section 46. Section 104 includes its own semi-cylindrical ferrule segment 107. Ferrule segments 106, 107 are of such length and are so positioned on antenna element section 46 that antenna element section 46 extends to its end 52 through virtually the entire length of ferrule segments 106, 107. The segments 106, 107 are held in position by the rivet 108 which passes across and through both of them and through an aligned opening in the antenna element section 46. The curvatures of the ferrule segments and of antenna element section 46, coupled with rivet 108, precludes any shifting of locking means 56 with respect to antenna element section 46.

Figure 3:
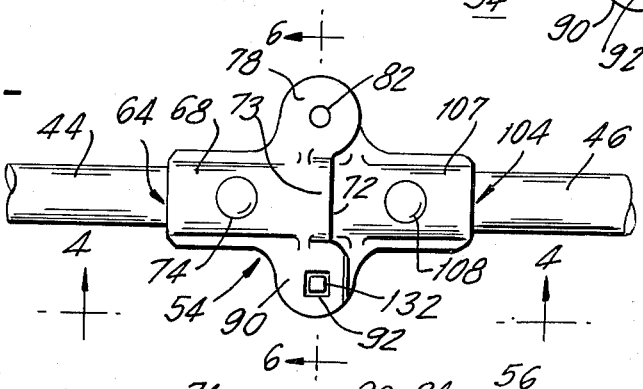
FIG. 3 is a side elevational view of the hinge of FIG. 2 with the antenna element locked straight.
Figure 4:
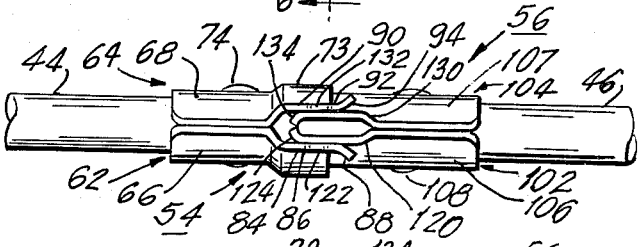
FIG. 4 is a bottom view in the direction of arrows 4 in FIG. 3 of the antenna element.

When the sections 44, 46 are brought to aligned condition illustrated in FIGS. 3 and 4, and the projections are in their respective openings 86, 92, the ferrule segments 66, 68 of lockable portion 54 are of such length that the free ends 72 thereof would overlap the ferrule segment, 106, 107 of the locking means 56 unless appropriate compensation were made to avoid this. Accordingly, the end portions 73 of both of the ferrule segments 66, 68 are flared or enlarged in diameter to provide a socket into which the unflared ends 110 of ferrule sections 106, 107 might fit. This insertion of ends 110 in flared section 73 further rigidifies the antenna element 42 against undesired twisting at the hinge 40.

The hinge part of locking means 56 has these characteristics. Projecting from one side of ferrule segment 106 is an enlarged contact plate extension 111, of substantially the same dimensions as plate extension 76, and having a flat outer surface that abuts the flat inner engagement surface of extension 76 and establishes secure electrical and mechanical engagement therewith when the rivet 82 secures these elements together.

Similarly, on the corresponding side thereof, segment 104 has an enlarged contact plate extension 112, which has the same characteristics as extension 111 and whose outer flat engagement surface abuts the enlarged flat inner engagement surface of extension 78 for secure mechanical and electrical engagement. In addition, the extensions 111, 112 are so placed on their respective ferrule segments 106, 107 that when rivet 82 is emplaced, plate extensions 111, 112 have their adjacent surfaces squeezed together, thereby providing secure electrical and mechanical contact. Like extensions 76, 78, extensions 111, 112 are provided with a clearance opening 113 therethrough for receiving hinge rivet 82. Opening 80, 113 is sized to permit relative pivoting of hinge portions 54, 56, so that hinge 40 can move from the condition illustrated in FIG. 2 to that illustrated in FIG. 3. The grip of rivet 82 is obviously not so tight as to preclude this pivoting. Similarly to extensions 76, 78, extensions 111, 112 are relatively quite large.

Ferrule segment 106 of locking means 56 is also provided with a contact plate extension and projection carrier 120 which extends away from the antenna element 42 in the opposite direction from extension 111. Like extension 84 with which it cooperates, either extension 120 itself and/or its mounting is resilient. On extension 120 is formed, by punching and then bending, a projection 122 that is dimensioned to be able to fit snugly in above discussed opening 86 in extension 84, with minimal play between the side edges of projection 122 and the cooperating side edges of opening 86.

Figure 5:
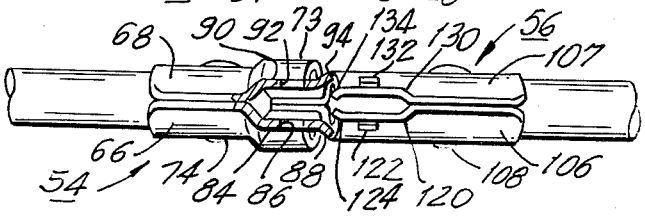
FIG. 5 is a similar view to FIG. 4 with the antenna element partially folded.
Figure 6:
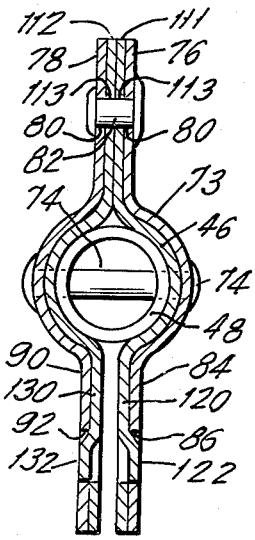
FIG. 6 is an elevational view in cross section of the antenna element of FIG. 3, along the line and in the direction of arrows 6 in FIG. 3.

At the entrance side (right side in FIG. 2) of extension 120 is an inwardly canted entrance guidance tab 124 which, as shown in FIGS. 4 and 5, abuts the corresponding entrance guidance tab 88 such that as antenna element sections 44, 46 are unfolded to their aligned condition of FIG. 3, the entrance tabs 88, 124 guide extension 84 outwardly at the same time as they guide extension 120 to shift slightly inwardly. This enables projection 122 to slide along the inner side of extension 84 until it snaps into aperture 86. Then, the normal resilience of extensions 84, 120 causes them to return to their previous positions and biases projection 122 securely in opening 86.

To ferrule section 107 is attached the same type of contact plate extension 130, projection 132, inwardly canted entrance tab 134 as are on extension 120, and on extension 130, these elements cooperate with above discussed contact plate extension 90 and its opening 92 and outwardly canted entrance tab 94 to guide entrance of projection 132 into opening 92. Extensions 120, 130 are also relatively quite large, and much larger than needed merely to support their respective projections, for the same reasons as extensions 84, 90 are enlarged.

The operation of antenna element hinge 40 is quite simple. The antenna element 42 starts in the condition of FIG. 2. Its sections 44, 46 are pivoted around hinge pin 82, through the condition illustrated in FIG. 5, to where the inclined entrance tabs 124, 134 cooperate respectively with the entrance tabs 88, 94 to force extensions 84, 90 outwardly while forcing the extensions 120, 130 inwardly, and further to where the projections 122, 132 pass along the inside of respective extensions 84, 90 and then respectively snap into the openings 86, 92, whereupon the resilience of the extensions 84, 90 and 120, 130 force these extensions to return to their normal condition and bias the projections 122, 132 securely into their respective openings 86, 92, thereby locking the antenna element together in the condition illustrated in FIGS. 3 and 4. The resilience of the extensions, coupled with the projections 122, 132 projecting sideways to the pivoting motion of antenna element sections 44, 46, and coupled with the side edges of the projections and their openings not enabling separation of the lock, makes refolding of the antenna element very difficult, as compared with the initial extending thereof. In this condition, and because of the enlarged size of the contact plate extensions 84, 90 and 120, 130, there is secure mechanical and electrical engagement between antenna element sections 44, 46.

One other feature of this construction is the large distance, relative to the diameter of antenna element 42 between hinge rivet 82 and the connection of projections 122, 132 in openings 86, 92. This greater distance more securely rigidifies the assembled antenna element 44, 46 than would a shorter distance between these elements, and minimizes rocking, twisting and shifting between the antenna element sections 44, 46. Also, the enlarged contact plate surfaces of extensions 84, 90 and 120, 130 cooperate to provide large mechanical contact surfaces which minimize relative coaxial twisting of the antenna element sections 44, 46. Further, the lapping of the lockable portion flared end portion 73 over the locking means end portions 110, minimizes the chances of rocking or bending of the antenna element sections 44, 46 with respect to each other.

Should it be desired to refold the antenna element 42 to the condition shown in FIG. 2, by forcing the extensions 84, 90 outwardly, they will be lifted off the projections 122, 132 and the antenna element 42 is then free to be refolded.

Although the present invention has been described in connection with a preferred embodiment thereof, many variations and modifications will now become apparent to those skilled in the art. It is preferred, therefore, that the present invention be limited not by the specific disclosure herein, but only by the appended claims.

We claim:

1. A self-locking hinge for an elongated element, wherein the elongated element has a longitudinal axis and is comprised of two generally coaxially alignable sections joined by said hinge;

said hinge comprising a lockable portion at an end of one elongated element section and locking means at an adjoining end of the other elongated element section;

said lockable portion comprising a first semi-cylindrical ferrule section fastened around said end of said one elongated element section, said ferrule section having a first hinge extension projecting in a first direction radially away from said one elongated element section and a first lockable means holding extension projecting radially away from said one elongated element section in a second direction opposite said first direction; said first hinge extension and said first lockable means holding extension both lying substantially in a first plane;

said locking means comprising a second semi-cylindrical ferrule section fastened around said end of said other elongated element section and having a second hinge extension projecting radially away from said other elongated element section, a first locking means holding extension projecting radially away from said other elongated element section and immovably secured at substantially an opposite edge of said second ferrule section; said second hinge extension and said locking means holding extension both lying substantially in a second plane;

said first and second hinge extensions respectively comprising a first and a second planar ear, each having a respective first surface in slidable engagement with and overlaid on the first surface of the other one of said first and second planar ears; said first surfaces being generally parallel to said element axis;

a hinge pin securing the overlaid hinge extension first surfaces together in a manner enabling relative pivoting of said ferrules with respect to each other;

said first lockable means holding extension and said first locking means holding extension respectively comprising a third and a fourth planar ear, each having confronting surfaces that are slidably engageable with one another upon pivoting of said ferrules to bring said ears into facewise engagement; said confronting surfaces being generally parallel to said element axis;

first lockable means on said lockable means holding extension; first lock means, lockable with said first lockable means, on said locking means holding extension; said lock means and said lockable means being so positioned on their respective said extensions that upon said second surfaces being pivoted into facewise engagement around said hinge pin, said lock means and said lockable means snappingly lock together.

2. The hinge of claim 1 wherein said first surfaces of said first and second ears and said second surfaces of said third and fourth ears have relatively large surface areas, as compared with the cross-section of said elongated element.

3. The hinge of claim 2, wherein said lock means comprises a projection from said second surface of said fourth ear and said lockable means comprises a projection receiving opening in said second surface of said third ear.

4. The hinge of claim 3, wherein said lock means projection is spaced away from said elongated element and said opening is similarly spaced away from said elongated element; said hinge pin being spaced away from said elongated element;

whereby the assembled elongated element is rigidified.

5. The hinge of claim 1, wherein each said ferrule has a respective end portion that faces toward the said end portion of the other said ferrule; said ferrule end portions extend toward each other a distance such that said ferrule end portions overlap upon engagement of said first lock means and said first lockable means;

one said ferrule end portion being flared wider than the other said ferrule end portion and being shaped to receive and surround said other ferrule end portion as said ferrule end portions overlap, thereby to further rigidify said elongated element.

6. The hinge of claim 3, wherein said third and said fourth ears are normally resiliently biased such that their said second surfaces are biased together; upon said lock means being pivoted into engagement with said lockable means, they resiliently snap together.

7. The hinge of claim 6, wherein said third and said fourth ears each have a respective entrance edge which faces the other of those said ears as those said ears are first moved into engagement;

a respective canted entrance tab at each said entrance edge and each said tab being inclined to move said second surfaces apart as said third and fourth ears are pivoted to the position at which said lock means and said lockable means are in engagement;

said third ear tab being positioned to also be engaged by said lock means projection, whereby that said projection urges further separation of said second surfaces until said lock means and said lockable means snap together.

8. The hinge of claim 6, wherein said elongated element is electrically conductive and said extensions are also electrically conductive.

9. The hinge of claim 8, wherein said elongated element is a signal receiving element of an antenna.

10. A self-locking hinge for an elongated element, wherein the elongated element has a longitudinal axis and is in two generally coaxially alignable sections that are joined by said hinge;

said hinge comprising a lockable portion at an end of one elongated element section and locking means at an adjoining end of the other elongated element section;

said lockable portion comprising a first hinge extension projecting away from and secured at one side of said one elongated element section; a first lockable means holding extension projecting away from and secured at substantially an opposite side of said one elongated element section; and a second lockable means holding extension projecting away from and secured substantially at said opposite side of said one elongated element section and being spaced from said first lockable means holding extension;

said locking means comprising a second hinge extension projecting away from and secured at one side of said other elongated element section; a first locking means holding extension projecting away from and secured at substantially an opposite side of said other elongated element section; and a second locking means holding extension projecting away from and secured substantially at said opposite side of said other elongated element section and being spaced from said first locking means holding extension;

said first and said second hinge extensions respectively comprise a first and a second plate each having a respective first surface in engagement with and overlaid on the first surface of the other one of said first and second plates; said first surfaces being generally parallel to said element axis;

a hinge pin securing the overlaid hinge extension first surfaces together in a manner enabling relative pivoting of said first surfaces with respect to each other while they remain in engagement;

said first lockable means holding extension and said first locking means holding extension respectively comprise a third and a fourth plate, each having a respective second surface that is engageable with and overlayable on the other of said second surfaces upon relative motion of said third and fourth plates into facewise engagement; said second surfaces being generally parallel to said element axis;

said second lockable means holding extension and said second locking means holding extension respectively comprise a fifth and a sixth plate, each having a respective third surface, which third surface is generally parallel to said element axis and faces away from said second surface of said third and fourth plates, respectively;

each said third surface being engageable with and overlayable with the other of said third surface upon relative moving of said fifth and sixth plates into facewise engagement;

first and second lockable means respectively on said first and second lockable means holding extensions; first and second lock means, respectively lockable with said first and second lockable means, on said first and second locking means holding extensions, respectively;

said first and second lock means and said first and second lockable means being so positioned on their respective extensions that upon the respective second and third surfaces being pivoted into facewise engagement around said hinge pin, said first lock means and said first lockable means lock together and said second lock and said second lockable means lock together.

11. The hinge of claim 10, wherein said first and said second lock means comprise a respective first projection from said second surface of said fourth plate and a second projection from said third surface of said sixth plate;

said first and second lockable means comprise a first projection receiving opening in said second surface of said third plate and a second projection receiving opening in said third surface of said fifth plate;

said third and said fourth plates being normally resiliently biased such that their said second surfaces are biased together; said fifth and said sixth plates being normally resiliently biased such that their said third surfaces are biased together;

upon said first and second lock means being pivoted into engagement with said first and second lockable means respectively, the cooperating said lock means and said lockable means resiliently snap lock together.

12. The hinge of claim 11, wherein said third and said fourth plates each have a respective entrance edge which faces the other of those said plates as those said plates are first moved into engagement; said fifth and said sixth plates also each have a respective entrance edge which faces the other of those said plates as those said plates are first moved into engagement;

a respective canted entrance tab at each said entrance edge; said tabs on said third and fourth plates being inclined to move said second surfaces apart as said third and fourth plates are pivoted to the positions at which said first lock means and said first lockable means are in engagement; said entrance tabs of said fifth and sixth plates being inclined to move said third surfaces apart as said fifth and sixth plates are pivoted to the position at which said second lock means and said second lockable means are in engagement;

said third and said fifth plate tabs being positioned to also be engaged by said first lock means projection and said second lock means projection, respectively, whereby those said projections urge further separation of said second surfaces and said third surfaces respectively, until said first lock means and said first lockable means snap together and said second lock means and said second lockable means snap together.

13. The hinge of claim 10, wherein said lockable portion comprises a third hinge extension projecting away from and secured substantially at said one side of said one elongated element section and spaced from said first hinge extension;

said locking means comprising a fourth hinge extension projecting away from and secured substantially at said one side of said other elongated element section;

said third and said fourth hinge extensions repectively comprise a seventh and an eighth plate each having a respective fourth surface in engagement with and overlaid upon the said fourth surface of the other of said seventh and eighth plates; said fourth surfaces being generally parallel to said elongated element axis;

said hinge pin also securing the overlaid said hinge extension fourth surfaces together in a manner enabling relative pivoting of said fourth surfaces with respect to each other while they remain in engagement.

14. The hinge of claim 13, wherein said first lock means comprises a first projection from said second surface of said fourth plate and said first lockable means comprises a projection receiving opening in said second surface of said third plate;

said second lock means comprises a second projection from said third surface of said sixth plate and said second lockable means comprises a second projection receiving opening in said third surface of said fifth plate.

15. The hinge of claim 14, further comprising a first ferrule fastened around said end of said one elongated element section and a second ferrule fastened around said adjoining end of said other elongated element section; said extensions being secured to and projecting from the said ferrules on the respective said elongated element sections.

16. The hinge of claim 15, wherein said first ferrule is comprised of two substantially identical but mirror imaged sections and said second ferrule is also comprised of two substantially identical but mirror image sections;

the first of said first ferrule sections including said first hinge extension and said first lockable means holding extenstion; the second of said first ferrule sections including said third hinge extension and said second lockable means holding extension;

the first of said second ferrule sections including said second hinge extension and said first locking means holding extension; the second of said second ferrule sections including said fourth hinge extension and said second locking means holding extension;

means nonmovably fastening said ferrule sections to their respective said elongated element sections.

17. The hinge of claim 14, wherein said elongated element is tubular.

18. The hinge of claim 14, wherein said elongated element is electrically conductive and said extensions are also electrically conductive.

19. The hinge of claim 18, wherein said elongated element is a tubular antenna element.

20. The antenna of claim 18, wherein said ferrules are electrically conductive.

21. The antenna of claim 20, wherein said elongated element is an antenna element.

* * * * *